US005873396A

United States Patent [19]

Biebrach et al.

[11] Patent Number: 5,873,396

[45] Date of Patent: Feb. 23, 1999

[54] SANDBAG-FILLING APPARATUS

[75] Inventors: James R. Biebrach, Northbrook; Kevin J. Kwaterski, Rolling Meadows, both of Ill.

[73] Assignee: Sandbag Systems, Inc., Wheeling, Ill.

[21] Appl. No.: 763,806

[22] Filed: Dec. 11, 1996

[51] Int. Cl.[6] ..... B65B 1/04

[52] U.S. Cl. ..... 141/231; 141/10; 141/313; 141/317; 141/362; 222/415; 222/627; 298/7; 414/507; 414/518; 414/519

[58] Field of Search ..... 141/10, 231, 313, 141/317, 351, 360–362; 298/7; 222/415, 626, 627; 414/507, 518, 519

[56] References Cited

U.S. PATENT DOCUMENTS

| | | | |
|---|---|---|---|
| 2,152,259 | 3/1939 | Humphrey | 222/627 |
| 2,408,906 | 10/1946 | Bocchicchio | 141/362 |
| 2,506,911 | 5/1950 | Zeigler | 222/627 |
| 2,532,698 | 12/1950 | Corkins | 141/362 |
| 2,548,611 | 4/1951 | Maslin | 141/231 |
| 2,973,110 | 2/1961 | Gentle | 298/7 |
| 3,003,262 | 10/1961 | De Biasi | 222/627 |
| 3,552,346 | 1/1971 | Garden | 141/72 |
| 3,690,392 | 9/1972 | Smith | 141/196 |
| 3,776,431 | 12/1973 | Riley | 222/627 |
| 3,841,508 | 10/1974 | Ebeling et al. | 414/406 |
| 3,951,284 | 4/1976 | Fell et al. | 214/152 |
| 4,044,921 | 8/1977 | Caverly | 222/74 |
| 4,098,433 | 7/1978 | Oligschlaeger | 222/627 |
| 4,445,628 | 5/1984 | Cain | 414/161 |
| 4,767,063 | 8/1988 | Wall et al. | 222/626 |
| 4,819,701 | 4/1989 | Thornton | 141/231 |
| 5,108,038 | 4/1992 | Palladino et al. | 222/626 |
| 5,215,127 | 6/1993 | Bergeron | 141/10 |
| 5,417,261 | 5/1995 | Kanzler et al. | 141/313 |
| 5,425,403 | 6/1995 | Herrmann | 141/314 |
| 5,437,318 | 8/1995 | Kanzler et al. | 141/313 |
| 5,564,886 | 10/1996 | Emerson et al. | 414/725 |

FOREIGN PATENT DOCUMENTS

| | | | |
|---|---|---|---|
| 1017224 | 1/1966 | United Kingdom | 222/627 |
| 1174057 | 12/1969 | United Kingdom | 222/627 |

OTHER PUBLICATIONS

Advertisement from Government Product News, Jan. 1997 issue.

*Primary Examiner*—J. Casimer Jacyna
*Attorney, Agent, or Firm*—Fitch, Even, Tabin & Flannery

[57] ABSTRACT

A vehicle comprising a motor for providing drive power to the vehicle, a hydraulic system powered by the motor, a container for containing a bulk quantity of fluent matter, and matter-dispensing apparatus comprising the hopper for receiving fluent matter from the container, a selectively operable transfer mechanism for transferring fluent matter from the container to the hopper, and an actuator disposed proximately to the hopper, the actuator being operatively associated with the transfer mechanism by the hydraulic system such that the transference of fluent matter from the container to the hopper is controlled by the actuator.

4 Claims, 4 Drawing Sheets

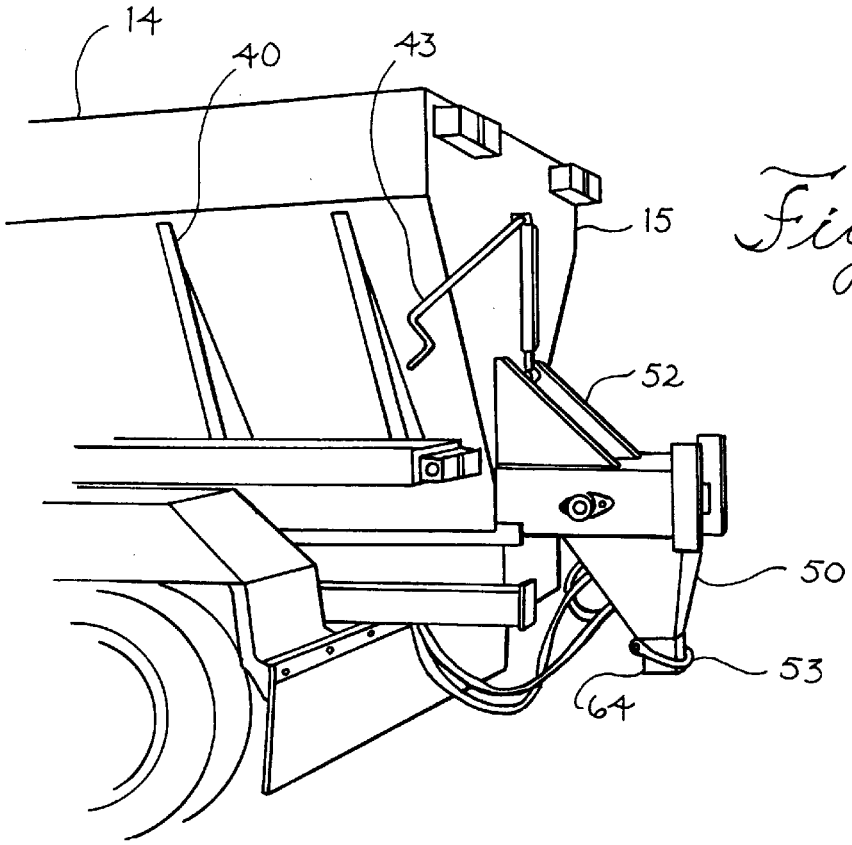
Fig. 2
Fig. 7
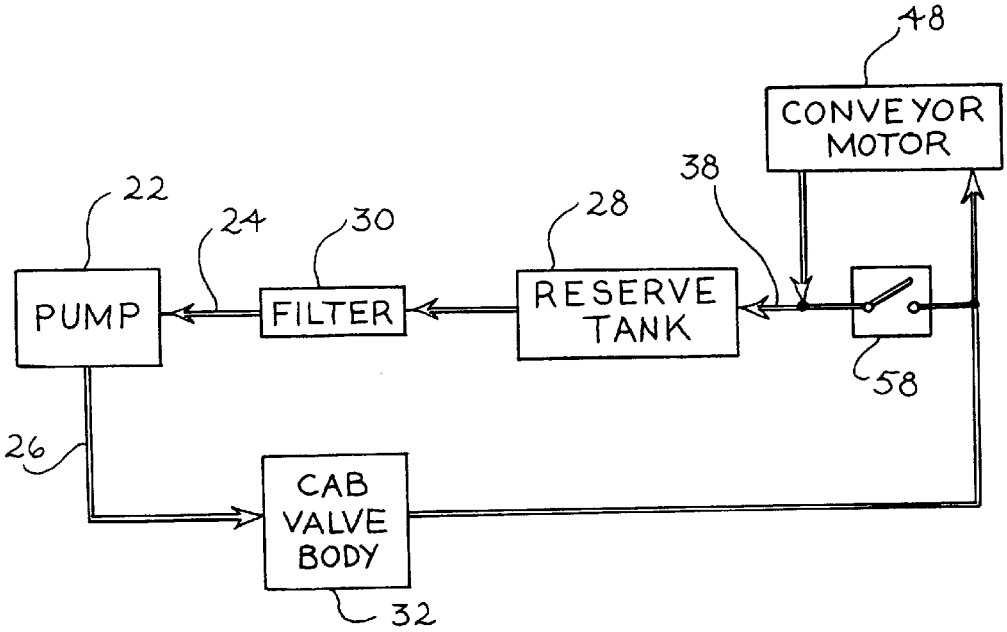

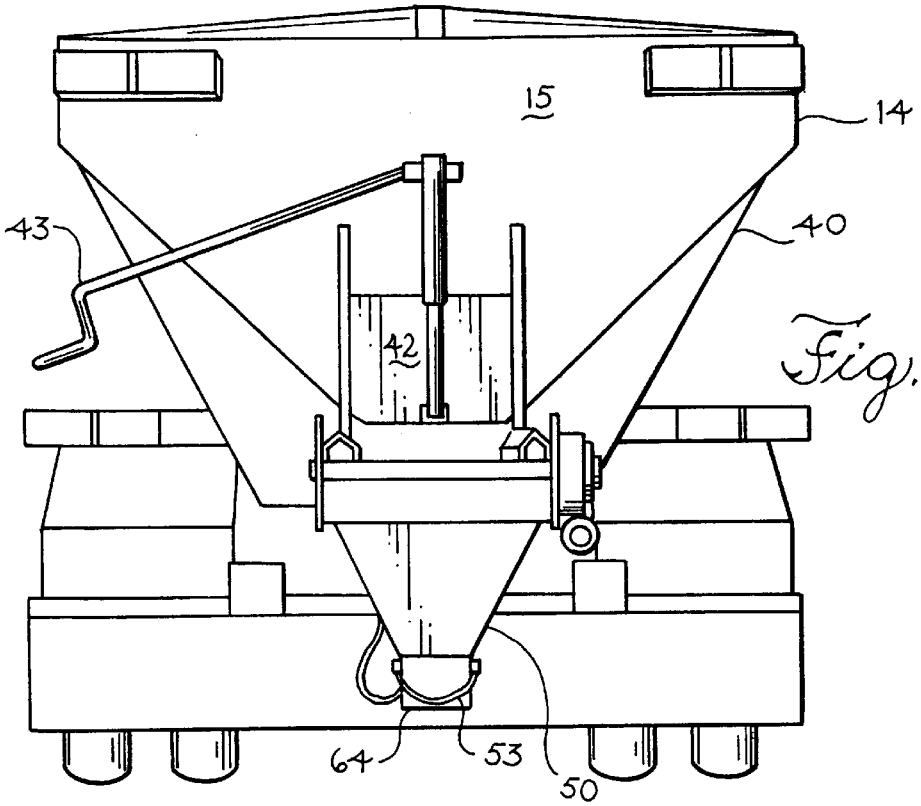
Fig. 4
Fig. 3
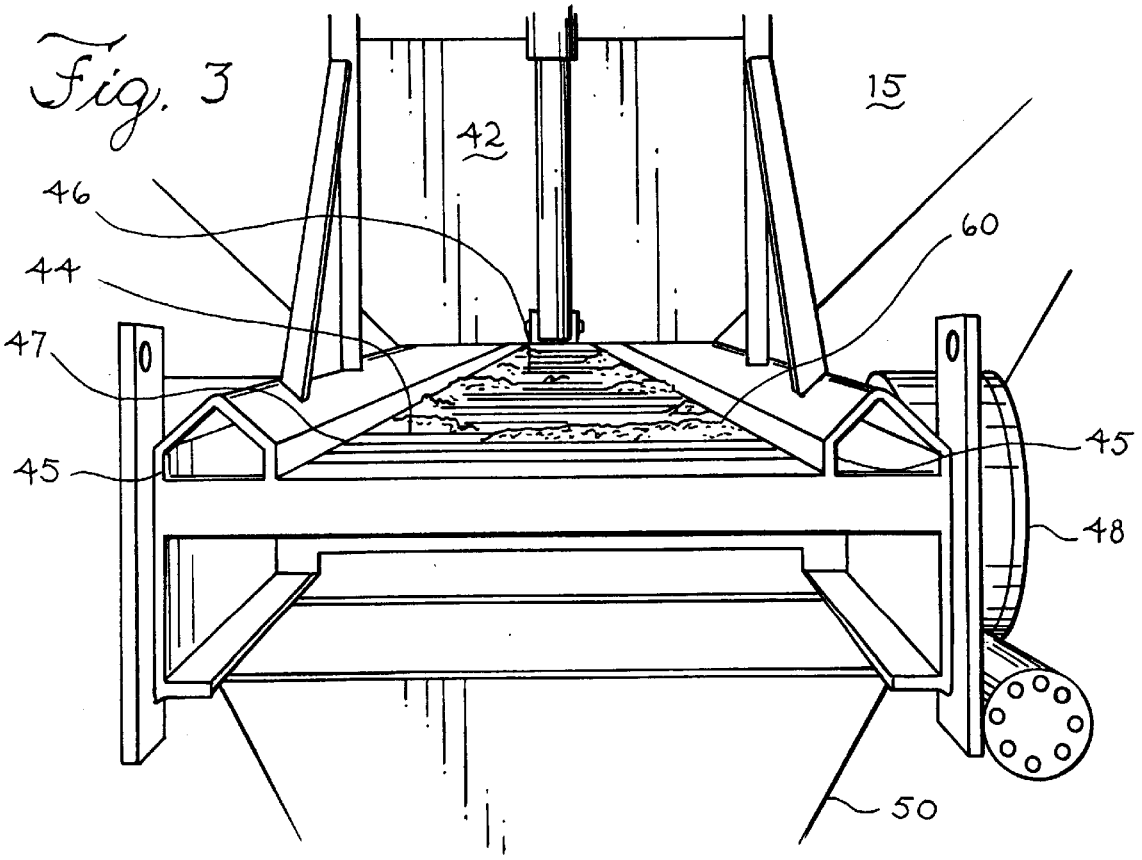

Fig. 5
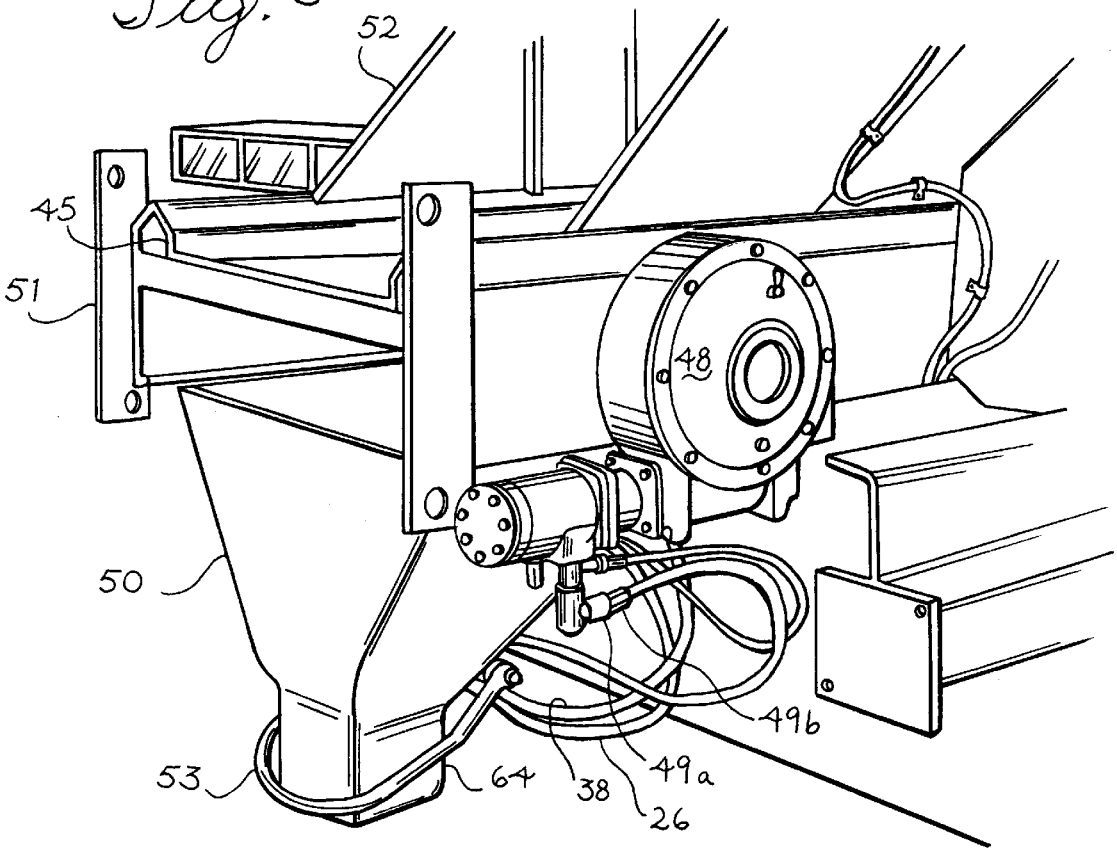
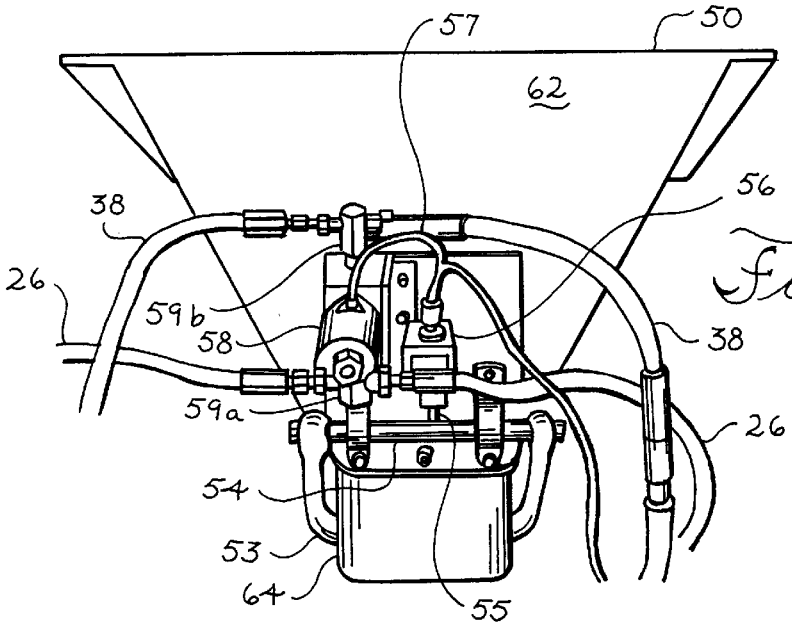
Fig. 6

SANDBAG-FILLING APPARATUS

BACKGROUND OF THE INVENTION

The invention relates to an apparatus for dispensing fluent matter, and more particularly, to a hopper and vehicle having a hydraulically driven apparatus to dispense fluent matter from the vehicle into individual receptacles.

Deformable receptacles containing fluent matter have been found to be effective in the formation of permanent or temporary barricades for preventing the passage of liquid therethrough. In particular, bags filled with sand or other substantially fluent material are used extensively to obstruct the flow of water and thereby protect property from potential water damage during a flood. Sandbags may also be used for a number of other applications, including for barricades at construction sites, for riot control, and for military fortification.

Filling such receptacles manually, however, is slow and difficult work, and is generally accomplished by one person holding a receptacle in an open position while a second person repeatedly shovels or otherwise carries fluent matter from a bulk source through the opening of the receptacle until the receptacle is appropriately filled. Relatively efficient two-person teams generally require about twenty to thirty seconds using such manual techniques to fill a single bag with approximately thirty pounds of fluent matter. Sandbags, however, are often demanded in large quantities and in emergency situations where time is of the essence. Thus, it is desirable to expedite the preparation and delivery of sandbags in such situations.

The problem facing providers of sandbags is the prompt and efficient delivery of sandbags to the application site. Obviously, a bulk source of fluent matter must be present at the site where the sandbags are to be filled. Thus, the sandbags must either be filled at a location remote from where the sandbags are to be applied or a bulk source of fluent matter must be transported to the application site. There are numerous advantages of the latter method with respect to the former. First, it is generally not known prior to arriving at the application site how many sandbags will be required. Thus, if one is required to remotely fill the sandbags, then it is likely that either too many or too few sandbags will be prepared. Obviously, if too many sandbags are prepared, one risks that the additional time required to prepare the extra sandbags will permit an emergency situation to worsen. Alternatively, if too few sandbags are prepared, one risks not being able to adequately address the emergency situation.

Another disadvantage of preparing sandbags at a location remote from the application site is that, once prepared, the sandbags must be transported to the application site. It generally requires considerable manpower to load and unload vehicles for transporting sandbags from a remote location to an application site. Thus, in order to reduce required manpower, it is desirable to fill the required sandbags very proximately to, or preferably at, the application site.

The difficulty with on-site filling is that it is usually manually performed and very arduous. Furthermore, one must transport a bulk quantity of fluent matter to the application site. In order to fill bags mechanically on-site, one must provide power to operate the filling apparatus. This has proven to be very difficult.

U.S. Pat. No. 5,417,261, issued to Kanzler et al., discloses a stand-alone filling apparatus designed to reduce the manpower needed to fill sandbags. A difficulty with such an apparatus, however, is that it would be difficult to transport it to an application site, particularly if heavy bulk fluent matter were already contained in the apparatus. Thus, such an apparatus is likely to be subject to all the remote-filling disadvantages discussed above. Furthermore, manufacturing the disclosed sandbag-filling apparatus would be quite expensive.

Others have made efforts at transportable sandbag-filling apparatus, but these efforts also have had significant disadvantages. Specifically, U.S. Pat. No. 3,552,346, issued to Garden, teaches a bagging attachment for the rear of a dump truck. The Garden patent requires the use of a hydraulic lift for raising the dump truck onto an angle so that the fluent matter therein may be received into a vibrating hopper. The disclosure of the power sources for the lift and vibrator is limited, however, and the patent indicates that multiple external power sources, such as air-cooled engines, could be needed. Furthermore, using such apparatus it would be difficult to closely regulate the amount of matter being vibrated into the bags.

U.S. Pat. No. 4,044,921, issued to Caverly, employs an external power plant comprising an internal combustion engine connected to an appropriate transmission to drive a power shaft that is mounted on appropriately located bearings attached to a support stand, and an electrically actuated drive clutch is mounted to the power shaft for driving a canvas belt. It is believed that such a means for powering a sandbag-filling apparatus is completely impractical and would be prohibitively expensive, both to construct and to maintain with proper fuel. Furthermore, it is believed that the canvas belt would be likely to become jammed by larger particulates within the fluent matter.

SUMMARY OF THE INVENTION

In accordance with the invention there is provided a vehicle comprising a motor for providing drive power to the vehicle, a hydraulic system powered by the motor, a container for containing a bulk quantity of fluent matter, and matter dispensing apparatus comprising a hopper for receiving fluent matter from the container, a selectively operable transfer mechanism for transferring fluent matter from the container to the hopper, and an actuator disposed proximately to the hopper, the actuator being operatively associated with the transfer mechanism by the hydraulic system such that the transference of fluent matter from the container to the hopper is controlled by the actuator.

The inventive vehicle enables prompt and efficient delivery of sandbags at the application site, and has significant advantages over the devices described above. First, the inventive vehicle carries a bulk quantity of fluent matter in a container to the application site rather than pre-filling an indeterminate number of bags. By filling the bags at the application site, the above-described disadvantages of remote-filling are avoided. Furthermore, if there are multiple application points at a given site, filled bags need not be carried from point to point. Rather, the vehicle may simply be driven from point to point so that the bags can be filled at the specific locations where they are to be applied.

Second, the inventive sandbag-filling apparatus can be used to fill sandbags much more quickly than by conventional means. Rather than requiring two operators approximately twenty to thirty seconds to fill one thirty pound bag, a preferred embodiment of the inventive apparatus can be used by a single operator to fill a thirty pound bag in approximately three seconds. Given that it generally requires approximately another three seconds to prepare a new bag for filling, the preferred embodiment of the inventive sandbag-filling apparatus can generally be used to fill ten bags per minute with one operator at the site of application, rather than remotely filling two bags per minute with two operators using conventional means.

Third, unlike prior art apparatus described above, the inventive sandbag-filling apparatus has an efficient power source. By drawing power into a hydraulic circuit directly from the motor of the vehicle, significant cost savings can be realized. External power systems, such as those disclosed in the '346 patent to Garden and the '921 patent to Caverly, are typically more expensive to build, buy, and operate than is the hydraulic system of the present invention.

BRIEF DESCRIPTION OF THE DRAWINGS

FIG. 2 is a perspective view of the rear portion of the vehicle shown in FIG. 1.

FIG. 3 is a perspective view of part of the rear portion of the vehicle shown in FIG. 1, particularly showing the transfer mechanism thereof.

FIG. 4 is a rear elevational view of the vehicle shown in FIG. 1.

FIG. 5 is a perspective view of part of the rear portion of the vehicle shown in FIG. 1, particularly showing the hopper thereof.

FIG. 6 is a perspective view of the front side of the hopper removed from the vehicle shown in FIG. 1.

FIG. 7 is a schematic view of a hydraulic system in accordance with the invention.

DESCRIPTION OF THE PREFERRED EMBODIMENT

Figure 1:
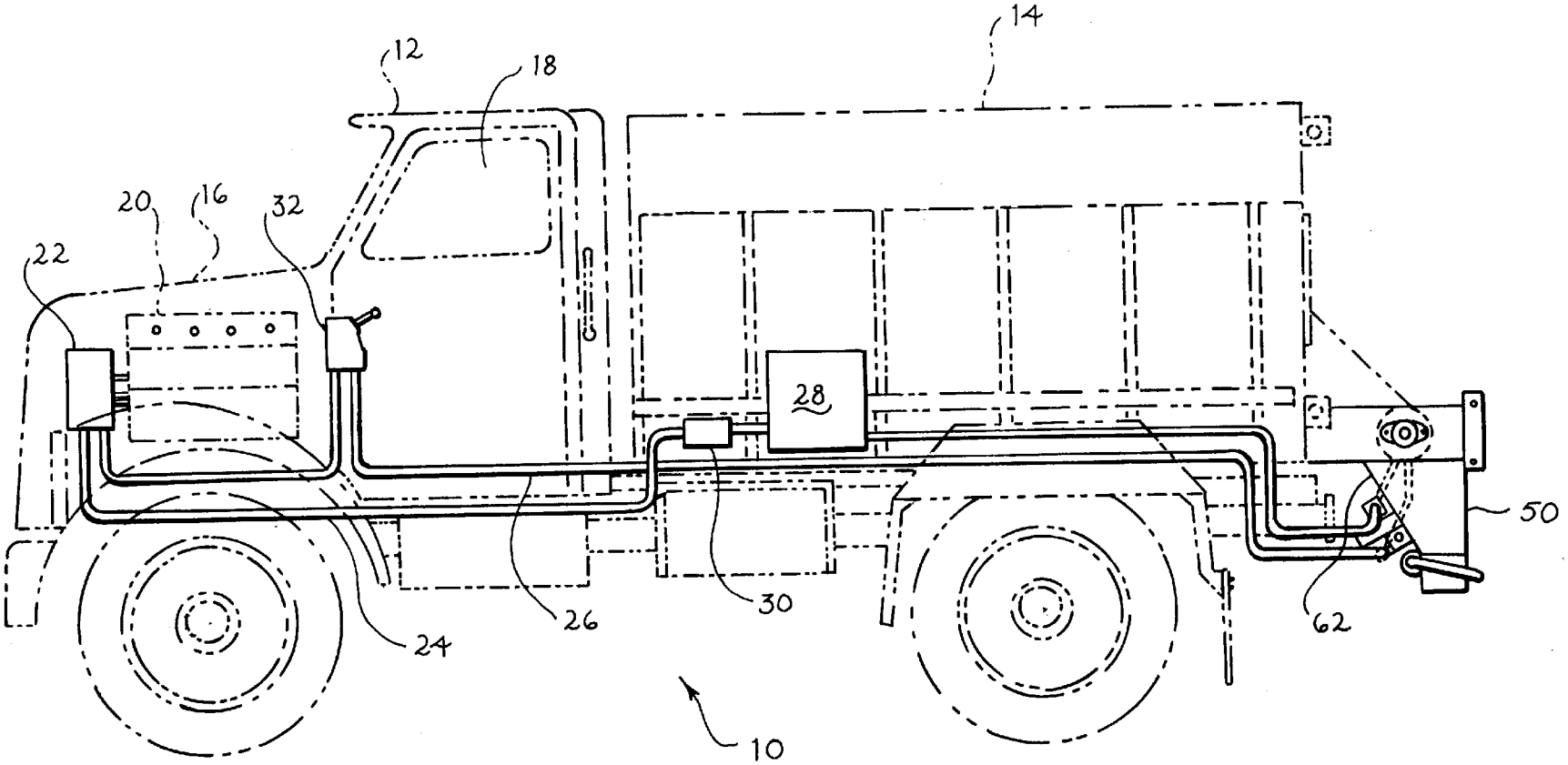
FIG. 1 is a side elevational view of a vehicle in accordance with the invention.

The preferred embodiment of the invention is a truck 10, shown primarily in broken lines in FIG. 1 to permit viewing of some interior components, the truck 10 having a cab 12 disposed in front of a container 14. At the front of the cab 12, housed under the hood 16, is a motor 20 for providing drive power to the truck 10 through a drive train and for providing power to a hydraulic pump 22 which is also housed under the hood 16 and disposed proximately to the motor 20.

As seen in FIGS. 2, 3, and 4, the container 14 is preferably a standard V-box type container such that it generally tapers inwardly toward the bottom of the container 14. Thus, as gravity pulls fluent matter 60 downwardly within the container 14, the V-shaped cross-section guides the fluent matter 60 onto a conveyor bed 44 which extends longitudinally along the bottom of the container 14. Extra support is preferably provided to the sidewalls of the container 14 by triangular container support ribs 40. There is also a gate 42 on the rear wall 15 of the container 14. The gate 42 can be vertically adjusted between a closed position and a continuum of open positions by rotating crank arm 43.

As seen particularly in FIG. 3, the conveyor bed 44 is longitudinally supported by guide rails 45 on both sides of the bed 44. A linked conveyor belt 46, comprising a series of individual conveyor slats 47 extending transversely across the bed 44 from one guide rail 45 to the other, encircles the bed 44 and is supported by the guide rail 45 and by a pair of sprockets connected by an axle at each longitudinal end of the conveyor bed 44. At least one axle and corresponding pair of sprockets is in rotational communication with a conveyor motor 48 which is selectively operable and driven by the hydraulic system. Activation of the conveyor motor 48 forces rotation of the axle and sprockets on one end of the conveyor bed 44, preferably the end at the rear of the truck 10 proximate to the motor 48, thereby driving the belt 46 around the conveyor bed 44 and pushing fluent matter 60 lying atop the bed 44 toward the gate 42 at the rear wall 15 of the container 14. When it is desired to operate the sandbag-filling apparatus, the gate 42 is opened with crank arm 43, thereby permitting fluent matter 60 to escape the container 14 through the gate 42. The conveyor belt 46 is then selectively operated to push fluent matter 60 through the gate 42, where it falls into a hopper 50.

As seen in FIG. 5, the hopper 50 preferably has four substantially trapezoidal sidewalls, including a front side wall 62, and a restricted neck portion 64 beneath and connecting the four sidewalls. The neck portion may be of rectangular cross-section, as seen in the figures, or may be substantially circular, or of any other appropriate shape. The sidewalls may be substantially vertical, but preferably at least one sidewall angles downwardly and inwardly to reduce the vertical cross-sectional area through which the fluent matter 60 falls. The narrowing produces a funneling effect and facilitates filling a receptacle held beneath the neck portion 64 with minimal spillage of fluent matter 60. The hopper 50 is supported behind the rear wall 15 of the container 14, and descends from cantilevered beams 51 of the conveyor guide rails 45. Additional support is provided to the cantilevered beams 51 by triangular stress plates 52.

The preferred disposition of the hydraulic system is shown in FIG. 1, and, for clarity, the preferred hydraulic system is shown schematically in FIG. 7. The system has a hydraulic pump 22 having an input line known as a feed line (or tank line) 24 and an output line called a pressure line 26. The pump 22 is disposed proximately to and is powered by the motor 20. The feed line 24 comes from a fluid reserve tank 28 preferably disposed along side the container 14, and the hydraulic fluid passes through a filter 30 on its way from the tank 28 to the pump 22.

The pressure line 26 preferably extends from the pump 22 into the operator chamber 18 of the cab 12. In the cab 12, there is apparatus for driving the truck 10, such as an accelerator, gear shift, steering wheel, etc. In the operator chamber 18, there is also preferably a valve body 32 in the pressure line 26. The valve body 32 can be adjusted by the truck operator to control the hydraulic pressure into the pressure line 26. From the valve body 32, the pressure line 26 extends through the back of the cab 12 and under the container 14 to the front side wall 62 of the hopper 50.

As seen in FIGS. 5 and 6, at the hopper 50, the pressure line 26 is in communication with a pressure end 59*a* of a valve body 58, preferably an electrical solenoid valve body. From the valve body 58, the pressure line 26 extends to a hydraulic fluid input 49*a* for the conveyor motor 48. The conveyor motor 48 also has a hydraulic fluid output 49*b* from where the hydraulic fluid exits the motor 48 and begins its return cycle. Thus, hydraulic return line 38 extends from the conveyor motor output 49*b* to the front side wall 62 of said hopper 50 where it is in communication with a return end 59*b* of the valve body 58. From the hopper 50, the return line 38 extends back to the fluid reserve tank 28 so that the fluid can be recycled. The vehicle may also include a second pressure line extending from said pump. In the preferred embodiment of the invention, the second pressure line is directed back into the reserve tank such that there is no significant pressure loss in the pressure line 26.

The valve body 58 is normally in an open state, permitting fluid flow therethrough. Thus, in its normal state, the valve body 58 acts as a short circuit between the pressure line 26 and the return line 38 because the fluid, primarily choosing the path of least resistance, flows through the valve body 58, into the return line 38, and back to the reserve tank 28 rather than the more resistive path of flowing through the conveyor motor 48 prior to recycling through the return line 38. Therefore, when the valve is in its normal open state, virtually no hydraulic fluid is flowing into the conveyor motor 48, and the conveyor belt 46 therefore is motionless.

In order to selectively operate the conveyor motor 48, the valve body 58 must be closed, thereby forcing the fluid through the conveyor motor 48 and back through the return line 38. The electrically operated solenoid valve body 58 is preferably activated through electrical communication 57 with microswitch 56 on the front side wall 62 of the hopper 50. Preferably, the microswitch 56 is toggled by depressing and releasing a button 55 on the perimeter of the microswitch 56.

To facilitate filling receptacles with minimal spillage of fluent material 60, the neck portion 64 of the hopper 50 is preferably restricted so that a receptacle can be held beneath the hopper 50 to receive the fluent matter 60 falling therethrough. To facilitate operation of the sandbag-filling apparatus by a single individual, an actuator ring 53 is preferably disposed to substantially encircle the neck portion 64 of the hopper 50 such that it is manually accessible to an individual who is holding a receptacle in place beneath the hopper 50. A substantially round actuator rod 54 having a cammed surface thereon supports the actuator ring 53 on the front side wall 62 of the hopper 50. The cammed surface of the rod 54 provides clearance for the microswitch button 55 so that the button 55 is ordinarily not depressed. By pressing downwardly on the actuator ring 53, however, the actuator ring 53 and actuator rod 54 are rotated so that the cammed surface of the rod 54 is angularly displaced such that the more radially outward portion of the cammed surface depresses the button 55 of the microswitch 56. In an alternative embodiment, the actuator may have a plurality or continuum of states to control the speed of the conveyor.

Thus, by pressing downwardly on the actuator ring 53 when holding a bag in place under the neck portion 64 of the hopper 50, the microswitch button 55 is depressed, thereby electrically activating the solenoid valve body 58 and obstructing the short circuit between the pressure line 26 and the return line 38 so that the hydraulic fluid is forced through conveyor motor 48. FIG. 7 illustrates the hydraulic system as described wherein the short circuit at valve body 58 is obstructed (represented by an open switch). Activation of the conveyor motor 48 rotates the slatted conveyor belt 46 around the conveyor bed 44 to force fluent matter 60 through the open gate 42, through the hopper 50, and finally into the bag.

From the foregoing it will be appreciated that the invention provides a novel hopper and vehicle for filling receptacles with fluent matter. The invention is not limited to the embodiment described herein, or to any particular embodiment.

Specific examples of alternative embodiments considered to be within the scope of the invention include embodiments where the hopper is disposed on the side wall of the container rather than on the rear wall, or where there may be more than one hopper, such as where one hopper is disposed on each sidewall. It is also considered within the scope of the invention to provide an embodiment using one or more augers, rather than, or in addition to one or more conveyors, to displace fluent matter toward a hopper. Another example of an alternative embodiment specifically considered to be within the scope of the invention is one wherein a foot pedal is disposed proximately to the hopper and is used instead of the above-described actuator ring to toggle the switch and valve body. Other modifications to the preferred embodiment may also be made within the scope of the invention.

What is claimed is:

1. A vehicle for delivering fluent matter to an application site and filling a plurality of deformable receptacles with said fluent matter, said vehicle comprising:

a motor in communication with a drive train for providing drive power to said vehicle;

a hydraulic system powered by said motor;

a container for containing a bulk quantity of said fluent matter therein; and matter-dispensing apparatus including:

a hopper for receiving said fluent matter from said container and guiding said fluent matter into one of said plurality of receptacles;

a selectively operable transfer mechanism for transferring said fluent matter from said container to said hopper; and an actuator disposed proximately to said hopper, said actuator being operatively associated with said transfer mechanism by said hydraulic system such that said transference of fluent matter from said container to said hopper is controlled by said actuator, wherein said actuator includes an actuator ring having two positions, a switch having an on position and an off position corresponding to said two positions, and a valve in communication with said hydraulic system, said valve having a first and second position, wherein toggling said actuator ring between its two positions correspondingly toggles said switch between its on and off positions and said valve between its first and second positions, said toggling of valve positions thereby affecting said hydraulic system;

said hopper including four substantially trapezoidal sidewalls and a neck portion, said switch and valve disposed substantially on one of said hopper sidewalls, said actuator ring being substantially connected to said hopper on said one of said hopper sidewalls and substantially encircling said neck portion of said hopper.

2. A vehicle in accordance with claim 1 wherein said actuator is disposed proximately to said hopper and oriented thereon such that a human user can manually hold a receptacle in position to receive fluent matter from said hopper and simultaneously manually engage said actuator.

3. A hopper comprising:

four substantially trapezoidal sidewalls having a converging end;

a neck portion joining said converging ends of said four sidewalls;

an electric switch disposed substantially on one of said hopper sidewalls;

a hydraulic valve disposed substantially on said one of said hopper sidewalls for affecting flow within a hydraulic system;

an actuator attached to said hopper on said one of said hopper sidewalls and substantially encircling said neck portion of said hopper, said actuator for toggling said electric switch.

4. A hopper in accordance with claim 3 wherein said actuator has an activated position and an inactivated position;

said switch has an on position corresponding to said activated position and an off position corresponding to said inactivated position; and said valve has a closed position corresponding to said on position and an open position corresponding to said off position, wherein toggling said actuator between its activated and inactivated positions correspondingly toggles said switch between its on and off positions and said valve between its closed and open positions.

* * * * *